US008824924B2

(12) United States Patent
Nakano

(10) Patent No.: US 8,824,924 B2
(45) Date of Patent: Sep. 2, 2014

(54) TRANSFER DEVICE AND IMAGE FORMING APPARATUS

(75) Inventor: Kuniaki Nakano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 720 days.

(21) Appl. No.: 13/083,672

(22) Filed: Apr. 11, 2011

(65) Prior Publication Data

US 2011/0249986 A1 Oct. 13, 2011

(30) Foreign Application Priority Data

Apr. 12, 2010 (JP) ..... 2010-091046

(51) Int. Cl.
*G03G 15/01* (2006.01)
*G03G 15/08* (2006.01)

(52) U.S. Cl.
USPC ..... 399/121; 399/302

(58) Field of Classification Search
USPC ..... 399/121, 302
See application file for complete search history.

(56) References Cited

U.S. PATENT DOCUMENTS

| | | | | |
|---|---|---|---|---|
| 6,134,415 | A * | 10/2000 | Iwakura et al. | 399/299 |
| 6,470,166 | B2 * | 10/2002 | Mizoguchi et al. | 399/302 |
| 6,850,726 | B1 | 2/2005 | Mizuno et al. | |
| 6,938,351 | B2 * | 9/2005 | Kobayashi et al. | 33/299 |
| 7,130,570 | B2 * | 10/2006 | Murakami et al. | 399/302 |
| 7,215,914 | B2 * | 5/2007 | Murakami et al. | 399/313 |
| 7,813,682 | B2 * | 10/2010 | Yokoi | 399/299 |
| 7,890,034 | B2 * | 2/2011 | Murayama et al. | 399/299 |
| 7,917,071 | B2 * | 3/2011 | Hirai et al. | 399/308 |
| 2003/0223785 | A1 * | 12/2003 | Kanekura et al. | 399/299 |
| 2004/0156658 | A1 * | 8/2004 | Aoki et al. | 399/313 |
| 2005/0036807 | A1 * | 2/2005 | Aoki et al. | 399/313 |
| 2005/0063739 | A1 * | 3/2005 | Kobayashi et al. | 399/299 |
| 2005/0141929 | A1 | 6/2005 | Mochizuki | |
| 2005/0141930 | A1 * | 6/2005 | Murakami et al. | 399/302 |
| 2005/0158074 | A1 * | 7/2005 | Murakami et al. | 399/121 |
| 2005/0185991 | A1 * | 8/2005 | Iwakura et al. | 399/299 |
| 2006/0245782 | A1 * | 11/2006 | Hirai et al. | 399/101 |
| 2006/0257176 | A1 * | 11/2006 | Kawasaki et al. | 399/299 |
| 2007/0071486 | A1 * | 3/2007 | Chiba et al. | 399/101 |
| 2007/0269241 | A1 * | 11/2007 | Sawai et al. | 399/299 |
| 2008/0003022 | A1 | 1/2008 | Sakashita et al. | |
| 2008/0095556 | A1 * | 4/2008 | Mochizuki | 399/308 |
| 2008/0310891 | A1 * | 12/2008 | Mochizuki | 399/302 |
| 2008/0317518 | A1 * | 12/2008 | Fukuhara | 399/302 |

FOREIGN PATENT DOCUMENTS

| | | | |
|---|---|---|---|
| JP | 2005-189359 | A | 7/2005 |
| JP | 2007-233100 | A | 9/2007 |
| JP | 2008-9011 | A | 1/2008 |
| WO | 02/056118 | A1 | 7/2002 |

* cited by examiner

*Primary Examiner* — David Bolduc
(74) *Attorney, Agent, or Firm* — Birch, Stewart, Kolasch & Birch, LLP

(57) ABSTRACT

A transfer device includes an intermediate transfer belt, and a plurality of intermediate transfer rollers. A most upstream side intermediate transfer roller which is located most upstream in a moving direction of the intermediate transfer belt has a rotational axis arranged downstream from a rotational axis of a most upstream side photoreceptor drum which is located most upstream in the moving direction of the intermediate transfer belt when the most upstream side intermediate transfer roller is in its pressing position, while a most downstream side intermediate transfer roller which is located most downstream in the moving direction of the intermediate transfer belt has a rotational axis arranged upstream from a rotational axis of a most downstream side photoreceptor drum which is located most downstream in the moving direction of the intermediate transfer belt when the most downstream side intermediate transfer roller is in its pressing position.

4 Claims, 8 Drawing Sheets

TRANSFER DEVICE AND IMAGE FORMING APPARATUS

CROSS REFERENCE

This Nonprovisional application claims priority under 35 U.S.C. §119(a) on Patent Application No. 2010-091046 filed in Japan on Apr. 12, 2010, the entire contents of which are hereby incorporated by reference.

BACKGROUND OF THE INVENTION

The present invention relates to a transfer device incorporated in an image forming apparatus for performing a primary transfer of developer images from a plurality of image bearing members arranged side by side onto an intermediate transfer belt and then performing a secondary transfer of the developer images from the intermediate transfer belt onto a recording medium. The present invention also relates to an image forming apparatus incorporating such a transfer device.

A tandem type full-color image forming apparatus having a plurality of image bearing members includes a transfer device configured to transfer an image onto a recording medium via an intermediate transfer belt. The transfer device is incorporated in the image forming apparatus in such a manner that a predetermined region of the outer peripheral surface of the intermediate transfer belt is opposed to the plurality of image bearing members. The transfer device includes a plurality of transfer members opposed to the respective image bearing members across the intermediate transfer belt. In a conventional transfer device having the transfer members located offset from the respective image bearing members, all the transfer members are offset downstream from the respective image bearing members in the moving direction of the intermediate transfer belt (see Japanese Patent Laid-Open Publication No. 2008-009011 for example).

Such a transfer device is designed such that in monochrome image formation a monochrome image transfer member assumes its pressing position while color image transfer members assume their separating positions. Thus, the intermediate transfer belt is brought into contact with the monochrome image bearing member while being separated from the color image bearing members. In full-color image formation, on the other hand, all the transfer members assume their respective pressing positions. Thus, the intermediate transfer belt is brought into contact with all the image bearing members.

In this way, the transfer members move in a direction such as to press the intermediate transfer belt against the image bearing members or in a direction such as to separate the intermediate transfer belt from the image bearing members so as to meet the monochrome image formation and the full-color image formation.

In recent years, demands exist for downsizing of image forming apparatuses. One of such demands is for downsizing of the transfer device in the moving direction of the intermediate transfer belt.

With the conventional transfer device, however, when the spacing is reduced between first and second entraining rollers about which the intermediate transfer belt is entrained in order to downsize the transfer device in the moving direction of the intermediate transfer belt, the spacing between that transfer member which is located at one end in the moving direction of the intermediate transfer belt and the adjacent one of the first and second entraining rollers and the spacing between that transfer member which is located at the other end in the moving direction of the intermediate transfer belt and the adjacent one of the first and second entraining rollers, are also reduced. For this reason, each of the transfer members located at opposite ends in the moving direction of the intermediate transfer belt might collide with a respective one of the first and second entraining rollers when the transfer members move in such a manner as to meet the monochrome image formation or the full-color image formation.

A feature of the present invention is to provide a transfer device and an image forming apparatus, both of which can be downsized in the moving direction of the intermediate transfer belt.

SUMMARY OF THE INVENTION

A transfer device is incorporated in an image forming apparatus for performing a primary transfer of developer images from a plurality of image bearing members arranged side by side onto an intermediate transfer belt and then performing a secondary transfer of the developer images from the intermediate transfer belt onto a recording medium. The transfer device includes the intermediate transfer belt, a plurality of transfer members, and a transfer member moving mechanism. The intermediate transfer belt is entrained about first and second entraining rollers to form a loop-shaped moving path opposed to the plurality of image bearing members. The plurality of transfer members are opposed to the respective image bearing members across the intermediate transfer belt for performing the primary transfer of the developer images born on the respective image bearing members onto the intermediate transfer belt when the transfer members are applied with voltage. The transfer member moving mechanism is configured to move the plurality of transfer members between their respective pressing positions for pressing the intermediate transfer belt against the plurality of image bearing members and their separating positions for separating the intermediate transfer belt from the plurality of image bearing members. A most upstream side transfer member which is a most upstream one of the plurality of transfer members in a moving direction of the intermediate transfer belt within a region opposed to the plurality of image bearing members has a rotational axis arranged downstream from a rotational axis of a most upstream side image bearing member which is a most upstream one of the plurality of image bearing members in the moving direction of the intermediate transfer belt when the most upstream side transfer member is in its pressing position, while a most downstream side transfer member which is a most downstream one of the plurality of transfer members in the moving direction of the intermediate transfer belt within the region opposed to the plurality of image bearing members has a rotational axis arranged upstream from a rotational axis of a most downstream side image bearing member which is a most downstream one of the plurality of image bearing members in the moving direction of the intermediate transfer belt when the most downstream side transfer member is in its pressing position.

In this construction, the intermediate transfer belt is entrained about the first and second entraining rollers. Therefore, the spacing between the first and second entraining rollers has to be reduced without reducing the range in which the intermediate transfer belt is opposed to the plurality of image bearing members in order to downsize the transfer device in the moving direction of the intermediate transfer belt. Since the transfer members are caused to move between their respective pressing positions and their respective separating positions in a required manner during the primary transfer, the first and second entraining rollers cannot be located in a region in which the transfer members move. However, since the rotational axis of the most upstream side transfer member is arranged downstream from the rotational axis of the most upstream side image bearing member in the moving direction of the intermediate transfer belt while the rotational axis of the most downstream side transfer member is arranged upstream from the rotational axis of the most downstream side image bearing member in the moving direction of the intermediate transfer belt, it possible to reduce the spacing between the first and second entraining rollers while avoiding collision of the most upstream side transfer member and the most downstream side transfer member with respective of the first and second entraining rollers. Thus, the present invention enables the transfer device and the image forming apparatus to be downsized in the moving direction of the intermediate transfer belt.

BRIEF DESCRIPTION OF THE DRAWINGS

FIG. 2A illustrates the positional relation in a standby state, FIG. 2B illustrates the positional relation in a monochrome image forming state, and FIG. 2C illustrates the positional relation in a full-color image forming state;

FIG. 5A illustrates the transfer member moving mechanism in the standby state, FIG. 5B illustrates the transfer member moving mechanism in the monochrome image forming state, and FIG. 5C illustrates the transfer member moving mechanism in the full-color image forming state;

FIG. 6A illustrates an intermediate transfer roller in a separating position, and FIG. 6B illustrates the intermediate transfer roller in a pressing position;

FIG. 7A illustrates the transfer member moving mechanism in the standby state, FIG. 7B illustrates the transfer member moving mechanism in the monochrome image forming state, and FIG. 7C illustrates the transfer member moving mechanism in the full-color image forming state.

DETAILED DESCRIPTION OF THE INVENTION

Hereinafter, an image forming apparatus 100 incorporating a transfer device 10 according to an embodiment of the present invention will be described with reference to the drawings.

Figure 1:
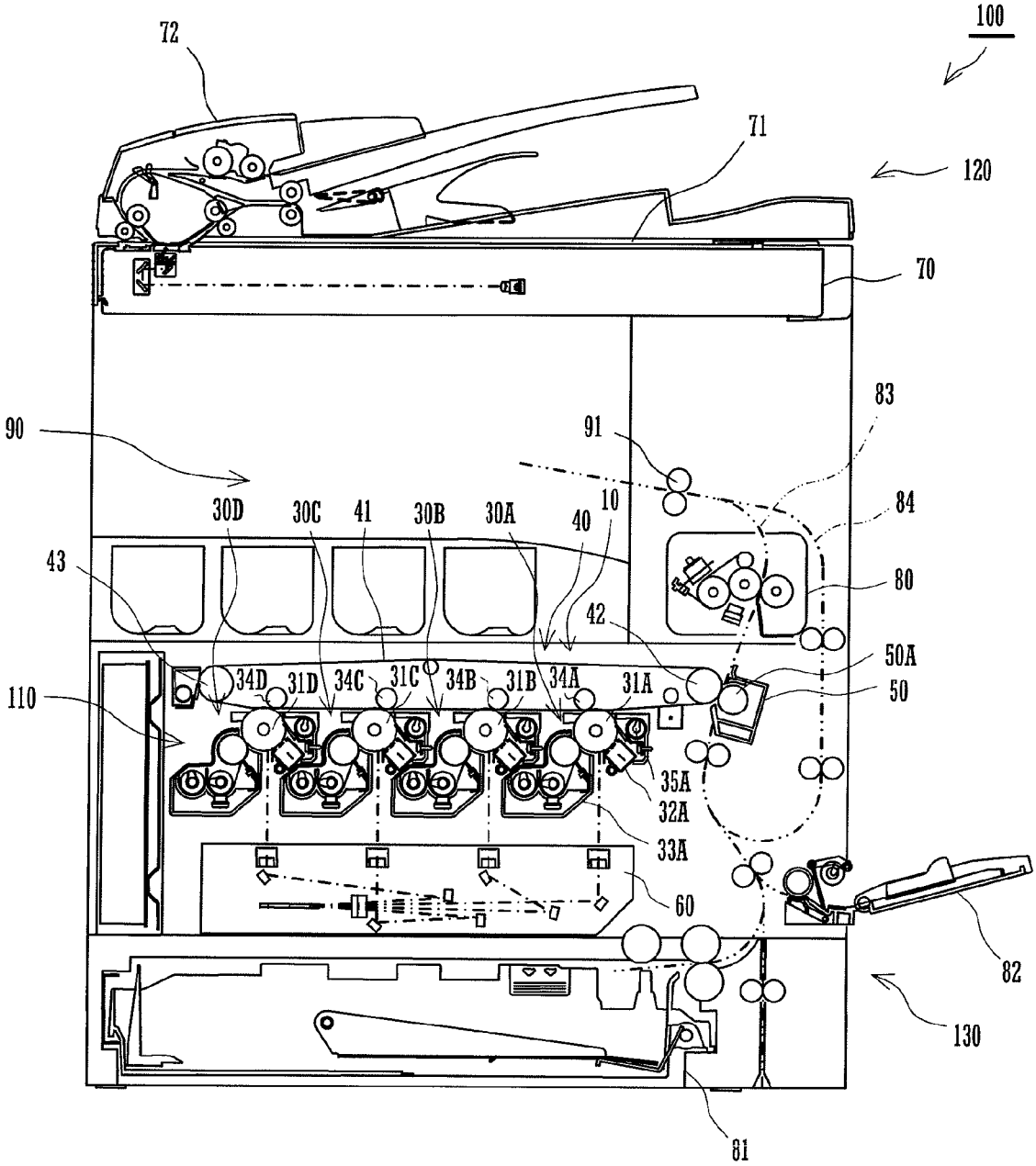
FIG. 1 is a sectional front elevational view schematically illustrating an image forming apparatus incorporating a transfer device according to an embodiment of the present invention.

The image forming apparatus 100 shown in FIG. 1 is configured to form a polychrome or monochrome image on a predetermined recording sheet (i.e., recording medium) according to image data read from a document. For this purpose, the image forming apparatus 100 includes an image reading device 120 on top of an apparatus body, and an image forming section 110 and a sheet feeding section 130 which are disposed inside the apparatus body.

The image reading device 120 includes a scanner unit 70, a document platen 71, and an automatic document feeder 72. The scanner unit 70 is configured to read image data from an image bearing side of the document placed on the top surface of the document platen 71 during a copying operation. The document platen 71, which is formed of hard sheet glass, is mounted on top of the apparatus body of the image forming apparatus 100. The top surface of the document platen 71 can be exposed and closed by the automatic document feeder 72. The automatic document feeder 72 is configured to feed documents placed on a document tray to a document catch tray one by one. On the way to the document catch tray, the scanner unit 70 reads image data from the image bearing side of each document.

The image forming section 110 includes an intermediate transfer belt unit 40, image forming stations 30A to 30D, a secondary transfer unit 50, an exposure unit 60, and a fixing unit 80.

The intermediate transfer belt unit 40 includes an intermediate transfer belt 41 which is an endless belt, a second entraining roller 42, a first entraining roller 43, and a tension roller 44. The intermediate transfer belt 41 is rotatably entrained about the first and second entraining rollers 43 and 42. The intermediate transfer belt 41 is formed using a film having a thickness of about 60 μm to about 150 μm. For instance, the second entraining roller 42 forms a driving roller, while the first entraining roller 43 forms a driven roller. The tension roller 44 acts to adjust the tension of the intermediate transfer belt 41.

The image forming stations 30A to 30D have a plurality of photoreceptor drums (i.e., image bearing members) including a monochrome image forming photoreceptor drum for bearing a black developer thereon (i.e., monochrome image bearing member), and color image forming photoreceptor drums for bearing respective color developers thereon (i.e., color image bearing members). The plurality of photoreceptor drums are arranged side by side so as to be opposed to a predetermined region of the intermediate transfer belt 41.

In the present embodiment, the image forming stations 30A to 30D perform electrophotographic image formation using developers of colors, i.e., black, cyan, magenta and yellow, respectively. The image forming stations 30B to 30D each have the same configuration as the image forming station 30A. The image forming stations 30A to 30D are arranged side by side in the moving direction of the intermediate transfer belt 41 (i.e., secondary scanning direction). The image forming station 30A, for example, has an electrostatic charger 32A, a developing device 33A, an intermediate transfer roller 34A and a cleaner device 35A which are disposed around a photoreceptor drum 31A. The image forming stations 30A to 30D have respective intermediate transfer rollers 34A to 34D, each of which forms a transfer member.

The intermediate transfer belt unit 40 and the intermediate transfer rollers 34A to 34D of the respective image forming stations 30A to 30D are included in the transfer device 10. The transfer device 10 is disposed in such a manner that the outer peripheral surface of the intermediate transfer belt 41 is opposed to the photoreceptor drums 31A to 31D.

The intermediate transfer roller 34A comprises a shaft formed of a metal material (e.g., stainless steel) and having a diameter of 8 mm to 10 mm, and an electrically conductive elastic material (e.g., urethane foam) covering the surface of the shaft. The intermediate transfer roller 34A is opposed to the associated photoreceptor drum 31A across the intermediate transfer belt 41. When applied with voltage, the intermediate transfer roller 34A applies voltage to the intermediate transfer belt 41 uniformly to perform a primary transfer of a toner image born on the photoreceptor drum 31A onto the intermediate transfer belt 41. The intermediate transfer roller 34A may be designed to be movable in a direction different from a direction normal to the peripheral surface of the photoreceptor drum 31A, i.e., a radial direction of the photoreceptor drum 31A.

The exposure unit 60 is configured to drive a semiconductor laser based on image data items corresponding to the respective colors, i.e., black, cyan, magenta and yellow which are read by the image reading device 120 to distribute laser light images corresponding to the respective colors to the image forming stations 30A to 30D. The exposure unit 60 may employ a light source other than the semiconductor laser, for example, an LED (light-emitting diode) array configured to be driven based on image data.

In the image forming station 30A for example, the peripheral surface of the photoreceptor drum 31A is electrostatically charged uniformly by the electrostatic charger 32A and then exposed to laser light distributed from the exposure unit 60 according to the black image data item. This causes an electrostatic latent image according to the black image data item to be formed on the peripheral surface of the photoreceptor drum 31A. Thereafter, the developing device 33A supplies the black developer to the peripheral surface of the photoreceptor drum 31A to visualize the electrostatic latent image into a black toner image. The toner image thus formed on the peripheral surface of the photoreceptor drum 31A is primarily transferred onto an outer peripheral surface of the intermediate transfer belt 41 by the intermediate transfer roller 34A applied with a primary transfer bias of opposite polarity (e.g., positive polarity) to the polarity (e.g., negative polarity) of the toner electrostatically charged. Residual toner remaining on the outer peripheral surface of the photoreceptor drum 31A is removed by the cleaner device 35A.

In monochrome image formation, only the monochrome image forming station 30A performs the image forming process described above. In full-color image formation, the image forming stations 30B to 30D as well as the image forming station 30A carry out the same process for the respective colors, i.e., cyan, magenta and yellow, as does the image forming station 30A. The resulting black, cyan, magenta and yellow toner images are sequentially transferred onto the outer peripheral surface of the intermediate transfer belt 41 by the intermediate transfer rollers 34A of the respective image forming stations 30A to 30D applied with the primary transfer bias so as to be superimposed on one another to form one image.

The sheet feeding section 130 includes a sheet feed cassette 81, a manual feed tray 82, a main sheet feed path 83, and a subsidiary sheet feed path 84. The sheet feed cassette 81 accommodates therein a plurality of recording sheets of a size and type which is used with a relatively high frequency. The manual feed tray 82 carries thereon a recording sheet of a size and type which is used with a relatively low frequency.

The main sheet feed path 83 is formed to extend from the sheet feed cassette 81 and the manual feed tray 82 to an output section 90 by passing between the intermediate transfer belt 41 and the secondary transfer unit 50 and through the fixing unit 80.

The secondary transfer unit 50 has a secondary transfer roller 50A and is configured to transfer the toner image born on the outer peripheral surface of the intermediate transfer belt 41 onto a recording sheet by the secondary transfer roller 50A applied with a secondary transfer bias of opposite polarity (e.g., positive polarity) to the polarity (e.g., negative polarity) of the toner electrostatically charged. The secondary transfer unit 50 is included in the transfer device 10.

The fixing unit 80 is configured to heat and pressurize the recording sheet bearing the toner image transferred thereto to fix the toner image to the recording sheet.

In order to keep the nip pressure between the secondary transfer roller 50A of the secondary transfer unit 50 and the intermediate transfer belt 41 at a predetermined value, one of the secondary transfer roller 50A and the second entraining roller 42 comprises a hard material (such as metal or the like) and the other comprises a soft material having elasticity (such as an elastic rubber roller, expanded resin roller, or the like).

The subsidiary sheet feed path 84 is formed to extend from an intermediate point on the main sheet feed path 83 between the fixing unit 80 and a sheet output roller 91 to a point on the main sheet feed path 83 upstream of the secondary transfer unit 50. In forming images on the both sides of a recording sheet, the subsidiary sheet feed path 84 guides the recording sheet to between the intermediate transfer belt 41 and the second transfer roller 50A after the recording sheet has been formed with an image on a first side thereof and then passed through the fixing unit 80. Before the recording sheet is fed into the subsidiary feed path 84, the recording sheet is front-back inverted by the sheet output roller 91.

Figure 2A:
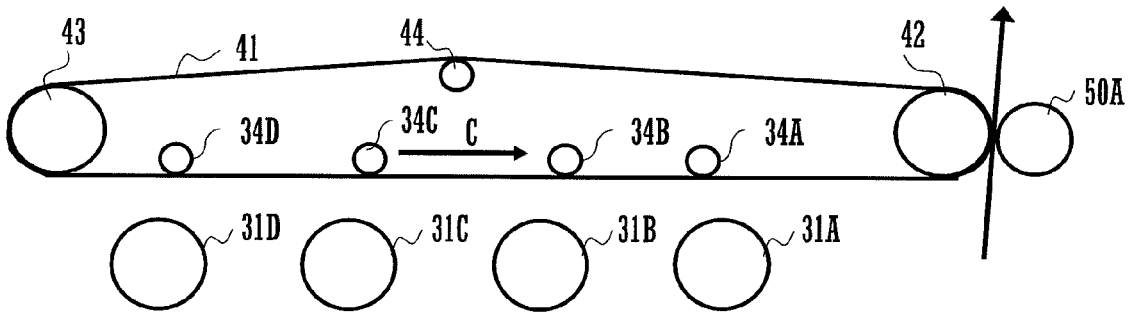
FIGS. 2A to 2C are views illustrating the positional relation between photoreceptor drums and intermediate transfer rollers, specifically.
Figure 2B:
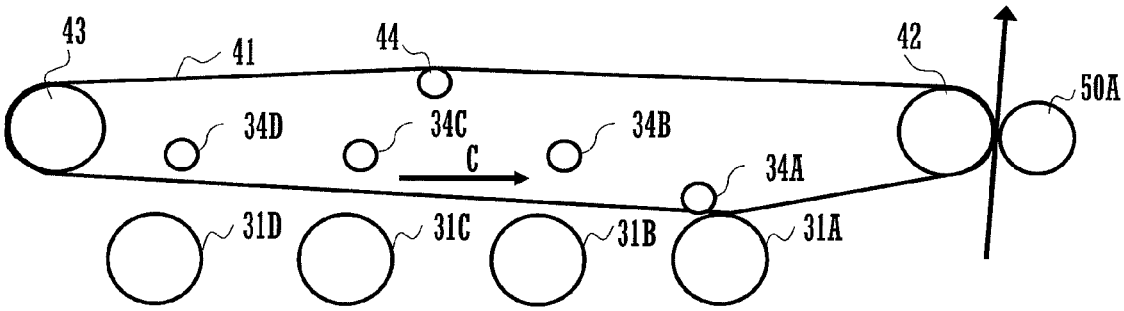
Figure 2C:
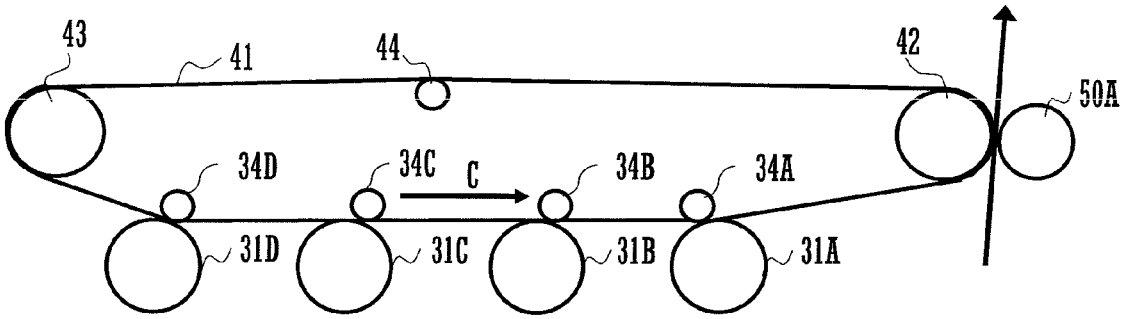
Figure 3:
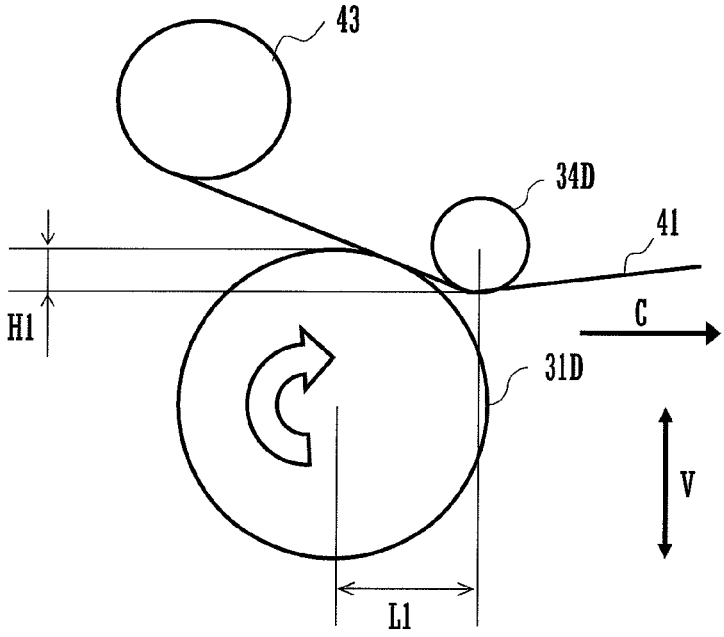
FIG. 3 is a view illustrating the positional relation between the most upstream side photoreceptor drum and the most upstream side intermediate transfer roller.
Figure 4:
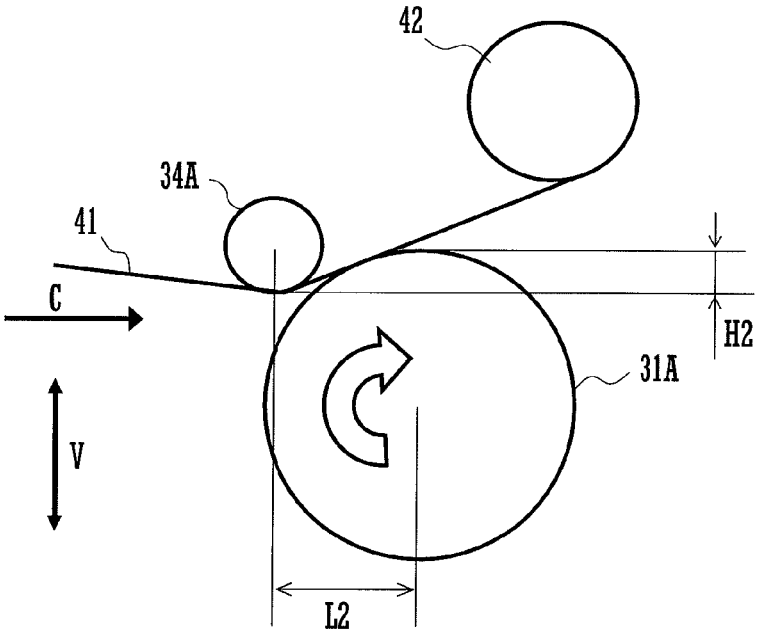
FIG. 4 is a view illustrating the positional relation between the most downstream side photoreceptor drum and the most downstream side intermediate transfer roller.

Referring to FIGS. 2 to 4, description will be made of the positional relation between the photoreceptor drums 31A to 31D and the intermediate transfer rollers 34A to 34D in the image forming section 110.

As shown in FIGS. 2A to 2D, the intermediate transfer belt 41 is entrained about the second entraining roller 42 and the first entraining roller 43 to form a predetermined loop-shaped moving path. Along the outer peripheral surface of the intermediate transfer belt 41 the photoreceptor drums 31D, 31C, 31B and 31A are disposed sequentially from the upstream side in a moving direction C of the intermediate transfer belt 41 within a region opposed to the photoreceptor drums 31A to 31D. The second entraining roller 42 and the first entraining roller 43 are located on the downstream side and the upstream side, respectively, in the moving direction C. The intermediate transfer rollers 34A to 34D are disposed so as to be opposed to the respective photoreceptor drums 31A to 31D across the intermediate transfer belt 41. In the present embodiment, the intermediate transfer belt 41 is positioned above the photoreceptor drums 34A to 34D.

Assuming that the moving direction C of the intermediate transfer belt 41 in the standby state coincides with the horizontal direction as shown in FIG. 2A, the lowermost portions of the second and first entraining rollers 42 and 43 and the lowermost portions of the intermediate transfer rollers 34A to 34D in the standby state are positioned in the same straight line. The lowermost portions of the second and first entraining rollers 42 and 43 are positioned higher than the uppermost portions of the photoreceptor drums 31A to 31D.

The intermediate transfer rollers 34A to 34D are designed to be movable between their respective pressing positions for pressing the intermediate transfer belt 41 against the plurality of photoreceptor drums 31A to 31D and their respective separating positions for separating the intermediate transfer belt 41 from the photoreceptor drums 31A to 31D by means of a transfer member moving mechanism 20 (see FIG. 5).

For example, the intermediate transfer rollers 34A to 34D are movable in the vertical direction, which is perpendicular to the moving direction C of the intermediate transfer belt 41 in the standby state, toward and away from the photoreceptor drums 31A to 31D which are opposed to the intermediate transfer rollers 34A to 34D, respectively. That is, the intermediate transfer rollers 34A to 34D press the intermediate transfer belt 41 against the photoreceptor drums 31A to 31D by moving toward the photoreceptor drums 31A to 31D and separate the intermediate transfer belt 41 from the photoreceptor drums 31A to 31D by moving away from the photoreceptor drums 31A to 31D.

During the full-color image formation, the transfer member moving mechanism 20 positions all the intermediate transfer rollers 34A to 34D in their respective pressing positions. During the monochrome image formation, the transfer member moving mechanism 20 positions the intermediate transfer roller 34A for monochrome image formation in its pressing position, the intermediate transfer roller 34A for monochrome image formation being the most upstream or downstream one of the plurality of intermediate transfer rollers 34A to 34D in the moving direction C of the intermediate transfer belt 41. At the same time therewith, the transfer member moving mechanism 20 positions the other intermediate transfer rollers 34B to 34D in their respective separating positions.

As shown in FIG. 2A, all the intermediate transfer rollers 34A to 34D assume their respective separating positions during the standby state and, hence, the intermediate transfer belt 41 is separated from the photoreceptor drums 31A to 31D. During the standby state, the rotational axes of the photosensitive drums 31A to 31D are positioned in a line and, likewise, the rotational axes of the intermediate transfer rollers 34A to 34D are positioned in a line. The direction of alignment of the rotational axes of the photoreceptor drums 31A to 31D and the direction of alignment of the rotational axes of the intermediate transfer rollers 34A to 34D are parallel with the moving direction C of the intermediate transfer belt 41.

In the present embodiment, the intermediate transfer roller 34A which is located most downstream in the moving direction C of the intermediate transfer belt 41 is used for monochrome image formation as shown in FIG. 2B. During the monochrome image formation, the intermediate transfer roller 34A for monochrome image formation (i.e., monochrome image transfer member) assumes its pressing position to press the intermediate transfer belt 41 against the photoreceptor drum 31A, while the intermediate transfer rollers 34B to 34D for color image formation (i.e., color image transfer members) assume their respective separating positions to separate the intermediate transfer belt 41 from the photoreceptor drums 31B to 31D.

In the monochrome image formation, a toner image is primarily transferred from the photoreceptor drum 31A onto the intermediate transfer belt 41 moving in the moving direction C by applying the primary transfer bias to the intermediate transfer roller 34A. When the recording sheet passes between the second entraining roller 42 and the secondary transfer roller 50A, the toner image is secondarily transferred from the intermediate transfer belt 41 onto the recording sheet by applying the secondary transfer bias to the secondary transfer roller 50A.

During the full-color image formation, all the intermediate transfer rollers 34A to 34D assume their respective pressing positions to press the intermediate transfer belt 41 against the photoreceptor drums 31A to 31D, as shown in FIG. 2C.

In the full-color image formation, by application of the primary transfer bias to the intermediate transfer rollers 34A to 34D toner images are transferred from the photoreceptor drums 31A to 31D sequentially onto the intermediate transfer belt 41 moving in the moving direction C so as to be superimposed on one another to form one image. When the recording sheet passes between the second entraining roller 42 and the secondary transfer roller 50A, the resulting toner image is secondarily transferred from the intermediate transfer belt 41 onto the recording sheet by applying the secondary transfer bias to the secondary transfer roller 50A.

As shown in FIG. 3, in the pressing position the rotational axis of the intermediate transfer roller 34D (i.e., the most upstream side transfer member) which is the most upstream one of the plurality of intermediate transfer rollers 34A to 34D is arranged downstream by a distance L1 from the rotational axis of the photoreceptor drum 31D (i.e., the most upstream side image bearing member) which is the most upstream one of the plurality of photoreceptor drums 31A to 31D in the moving direction C of the intermediate transfer belt 41.

As shown in FIG. 4, in the pressing position the rotational axis of the intermediate transfer roller 34A (i.e., the most downstream side transfer member) which is the most downstream one of the plurality of intermediate transfer rollers 34A to 34D is arranged upstream by a distance L2 from the rotational axis of the photoreceptor drum 31A (i.e., the most downstream side image bearing member) which is the most downstream one of the plurality of photoreceptor drums 31A to 31D in the moving direction C of the intermediate transfer belt 41.

In the pressing positions the rotational axes of the intermediate transfer rollers 34B and 34C other than the most upstream side intermediate transfer roller 34D and the most downstream side intermediate transfer roller 34A are arranged downstream by respective distances L3 and L4 from the rotational axes of the photoreceptor drums 31B and 31C opposed thereto in the moving direction C of the intermediate transfer belt 41. Note that the distances L3 and L4 are omitted from the drawings.

In the present embodiment, the distances L1, L2, L3 and L4 are equal to each other.

Since the rotational axis of the most upstream side intermediate transfer roller 34D in the pressing position is arranged downstream from the rotational axis of the most upstream side photoreceptor drum 31D in the moving direction C of the intermediate transfer belt 41 while the rotational axis of the most downstream side intermediate transfer roller 34A in the pressing position is arranged upstream from the rotational axis of the most downstream side photoreceptor drum 31A in the moving direction C of the intermediate transfer belt 41, the intermediate transfer rollers 34A and 34D moving between the their pressing positions and their separating positions in the primary transfer operation can avoid colliding with respective of the first and second entraining rollers 43 and 42 even when the spacing between the first and second entraining rollers 43 and 42 is reduced without reducing the range in which the intermediate transfer belt 41 is opposed to the plurality of photoreceptor drums 31A to 31D. Therefore, the transfer device 10 can be downsized in the moving direction C of the intermediate transfer belt 41.

The first entraining roller 43 which is located upstream of the second entraining roller 42 in the moving direction C of the intermediate transfer belt 41 partially overlaps the most upstream side photoreceptor drum 31D in the moving direction C of the intermediate transfer belt 41.

Even though the first entraining roller 43 partially overlaps the photoreceptor drum 31D in the moving direction C of the intermediate transfer belt 41, the arrangement in which the rotational axis of the intermediate transfer roller 34D in the pressing position is arranged downstream from the rotational axis of the photoreceptor drum 31D in the moving direction C of the intermediate transfer belt 41, can avoid collision of the intermediate transfer roller 34D with the first entraining roller 43. For this reason, the first entraining roller 43 and the photoreceptor drum 31D can be disposed to overlap each other partially in the moving direction C of the intermediate transfer belt 41. Therefore, the spacing between the first and second entraining rollers 43 and 42 can be further reduced, which makes it possible to further downsize the transfer device 10 in the moving direction C of the intermediate transfer belt 41.

It is also possible that the second entraining roller 42 which is located downstream of the first entraining roller 43 in the moving direction C of the intermediate transfer belt 41 partially overlaps the most downstream side photoreceptor drum 31A in the moving direction C of the intermediate transfer belt 41.

Even though the second entraining roller 42 partially overlaps the photoreceptor drum 31A in the moving direction C of the intermediate transfer belt 41, the arrangement in which the rotational axis of the intermediate transfer roller 34A in the pressing position is arranged upstream from the rotational axis of the photoreceptor drum 31A in the moving direction C of the intermediate transfer belt 41, can avoid collision of the intermediate transfer roller 34A with the second entraining roller 42. For this reason, the second entraining roller 42 and the photoreceptor drum 31A can be disposed to overlap each other partially in the moving direction C of the intermediate transfer belt 41. Therefore, the spacing between the first and second entraining rollers 43 and 42 can be further reduced, which makes it possible to further downsize the transfer device 10 in the moving direction C of the intermediate transfer belt 41.

In the pressing position the intermediate transfer roller 34D partially overlaps the opposite photoreceptor drum 31D in a direction V perpendicular to the moving direction C by a distance H1 in the direction V. In the present embodiment, the lowermost peripheral edge portion of the intermediate transfer roller 34D is positioned lower than the uppermost peripheral edge portion of the photoreceptor drum 31D by the distance H1 in the direction V.

In the pressing position the intermediate transfer roller 34A partially overlaps the opposite photoreceptor drum 31A in the direction V perpendicular to the moving direction C by a distance H2 in the direction V. In the present embodiment, the lowermost peripheral edge portion of the intermediate transfer roller 34A is positioned lower than the uppermost peripheral edge portion of the photoreceptor drum 31A by the distance H2 in the direction V.

The distance H2, which is defined as the distance in the direction V between the uppermost peripheral edge portion of the photoreceptor drum 31A and the lowermost peripheral edge portion of the opposite intermediate transfer roller 34A, is 1 mm for example. The intermediate transfer roller 34A assumes its pressing position correctly by bringing its own bearing portion (not shown) into contact with a holder member (not shown) holding the photoreceptor drum 31A.

In the pressing position the intermediate transfer roller 34B partially overlaps the opposite photoreceptor drum 31B in the direction V perpendicular to the moving direction C by a distance H3 in the direction V. In the present embodiment, the lowermost peripheral edge portion of the intermediate transfer roller 34B is positioned lower than the uppermost peripheral edge portion of the photoreceptor drum 31B by the distance H3 in the direction V.

In the pressing position the intermediate transfer roller 34C partially overlaps the opposite photoreceptor drum 31C in the direction V perpendicular to the moving direction C by a distance H4 in the direction V. In the present embodiment, the lowermost peripheral edge portion of the intermediate transfer roller 34C is positioned lower than the uppermost peripheral edge portion of the photoreceptor drum 31C by the distance H4 in the direction V. Note that the distances H3 and H4 are omitted from the drawings.

The pressing position of the most upstream side intermediate transfer roller 34D and that of the most downstream side intermediate transfer roller 34A are set closer to the photoreceptor drums 31D and 31A than the pressing positions of the other intermediate transfer rollers 34B and 34C in the direction V perpendicular to the moving direction C of the intermediate transfer belt 41. In the present embodiment, the pressing position of the most upstream side intermediate transfer roller 34D and that of the most downstream side intermediate transfer roller 34A are set lower than the pressing positions of the other intermediate transfer rollers 34B and 34C in the direction V. Stated otherwise, the distances H1 and H2 are larger than the distances H3 and H4. The distances H1 to H4 are established so that the nip widths between the photoreceptor drums 31A to 31D and the intermediate transfer belt 41 are equal to each other.

By setting the pressing positions of the intermediate transfer rollers 34D and 34A closer to the photoreceptor drums 31D and 31A in the direction V, the amount of pressing against the intermediate transfer belt 41 increases. The amount of pressing by each of the intermediate transfer rollers 34A to 34D is defined as the amount of movement of the intermediate transfer roller from the time when the intermediate transfer roller comes into contact with the intermediate transfer belt 41 until the intermediate transfer roller assumes its pressing position. Though the rotational axis of the intermediate transfer roller 34D is arranged downstream from that of the photoreceptor drum 31D in the moving direction C of the intermediate transfer belt 41, the increased amount of pressing by the intermediate transfer roller 34D can prevent the nip width between the photoreceptor drum 31D and the intermediate transfer belt 41 from decreasing. Likewise, though the rotational axis of the intermediate transfer roller 34A is arranged upstream from that of the photoreceptor drum 31A in the moving direction C of the intermediate transfer belt 41, the increased amount of pressing by the intermediate transfer roller 34A can prevent the nip width between the photoreceptor drum 31A and the intermediate transfer belt 41 from decreasing. Therefore, the transfer device 10 can be downsized in the moving direction C of the intermediate transfer belt 41 while suppressing the occurrence of a transfer failure.

Since the rotational axis of the most downstream side intermediate transfer roller 34A is arranged upstream from that of the opposite photoreceptor drum 31A in the moving direction C of the intermediate transfer belt 41, the angle at which the intermediate transfer belt 41 comes into contact with the photoreceptor drum 31A is not varied by a change in state from the full-color image forming state to the monochrome image forming state and vice versa. For this reason, it is possible to downsize the transfer device 10 and the image forming apparatus 100 in the moving direction C of the intermediate transfer belt 41 as well as to ensure a good primary transfer in the full-color image formation and the monochrome image formation both.

Further, since the rotational axis of the most upstream side intermediate transfer roller 34D is arranged downstream from that of the most upstream side photoreceptor drum 31D in the moving direction C of the intermediate transfer belt 41, an excessive rise in the tension of the intermediate transfer belt 41 is not likely as compared with an arrangement in which the rotational axis of the intermediate transfer roller 34D is arranged upstream from that of the photoreceptor drum 31D. Similarly, since the rotational axis of the most downstream side intermediate transfer roller 34A is arranged upstream from that of the most downstream side photoreceptor drum 31A in the moving direction C of the intermediate transfer belt 41, an excessive rise in the tension of the intermediate transfer belt 41 is not likely as compared with an arrangement in which the rotational axis of the intermediate transfer roller 34A is arranged downstream from that of the photoreceptor drum 31A. Therefore, the occurrence of a primary transfer failure, such as character missing, due to agglomeration of toner on the intermediate transfer belt 41 can be suppressed.

Because the photoreceptor drum 31D is supplied with the developer corresponding to a color (yellow) of which transfer failure is inconspicuous, a transfer failure in the secondary transfer step is inconspicuous even when the transfer failure due to agglomeration of toner is caused by the intermediate transfer roller 34D pressed against the photoreceptor drum 31D is across the intermediate transfer belt 41.

As described above, the transfer device 10 can suppress image quality degradation without increasing the parts count, specifically, without the provision of a separate roller on the upstream side of the photoreceptor drum 31D for pressing the intermediate transfer belt 41 against the photoreceptor drum 31D located on the most upstream side in the moving direction C of the intermediate transfer belt 41 in addition to the intermediate transfer roller 34D. Therefore, an increase in cost can be suppressed.

Description will be made of the arrangement of the transfer member moving mechanism 20.

Figure 5A:
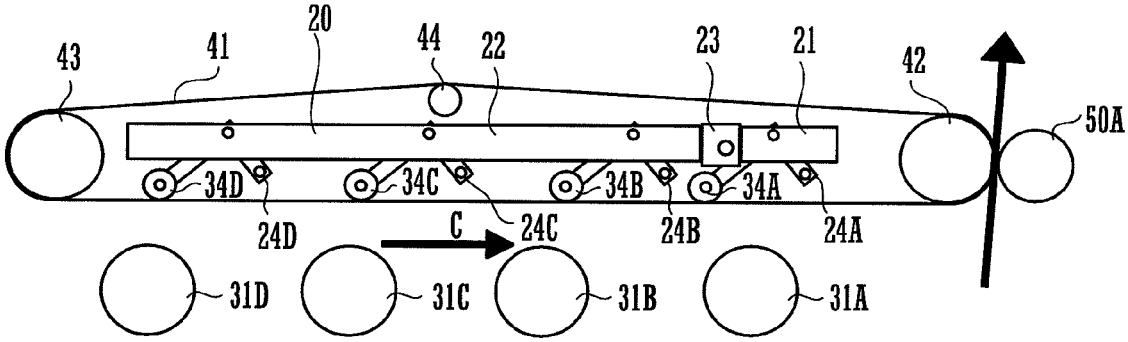
FIGS. 5A to 5C are views illustrating the arrangement of a transfer member moving mechanism, specifically.
Figure 5B:
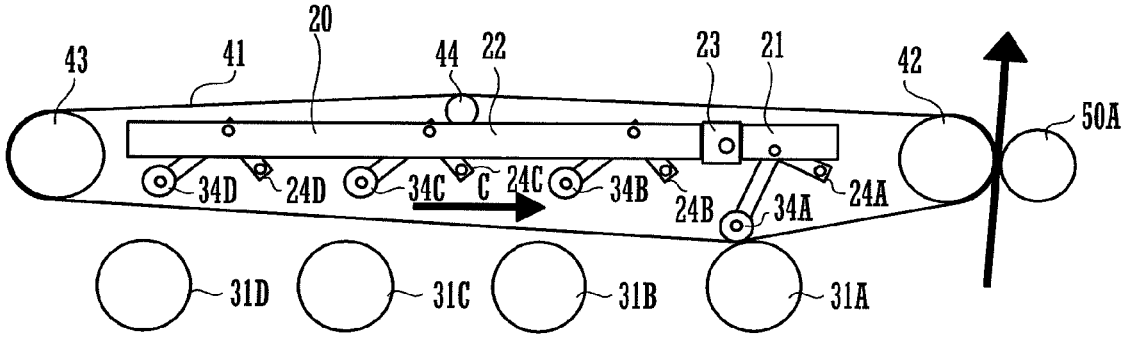
Figure 5C:
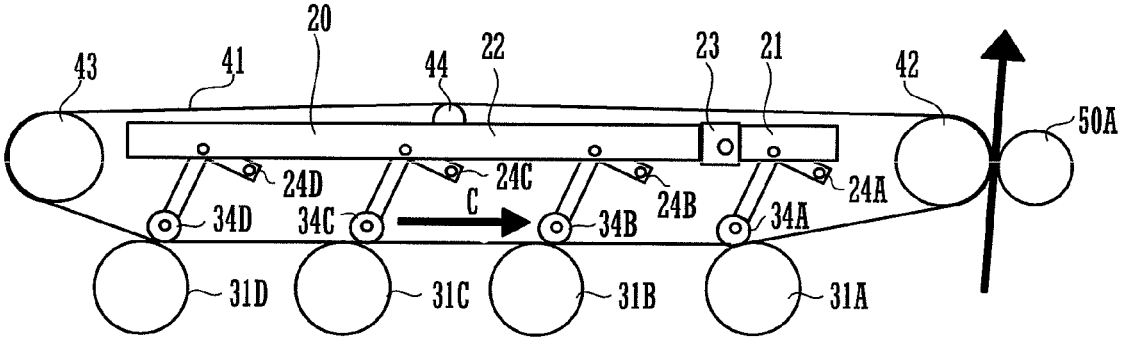
Figure 6A:
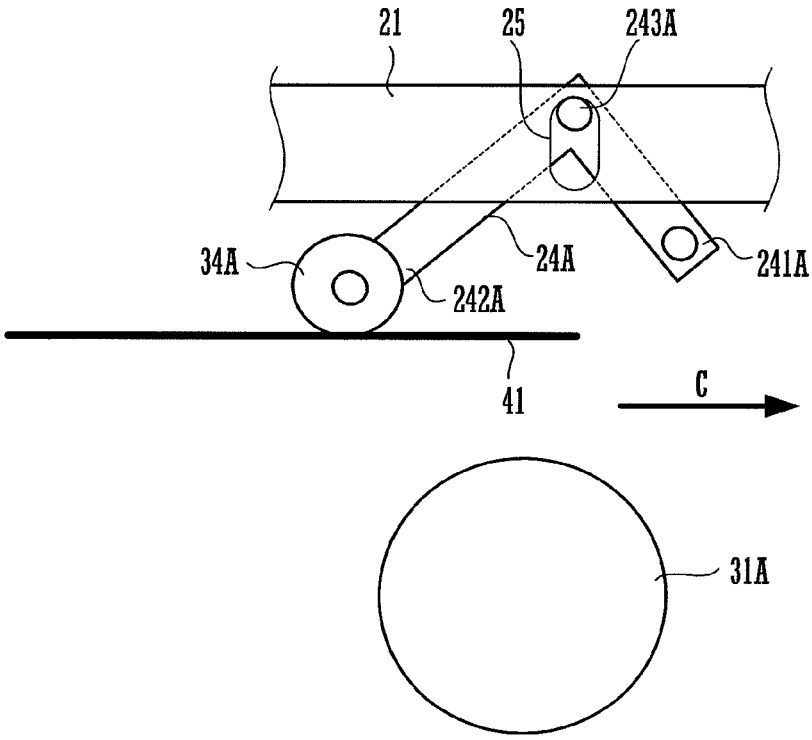
FIGS. 6A and 6B are enlarged views of a part of the transfer member moving mechanism, specifically.
Figure 6B:
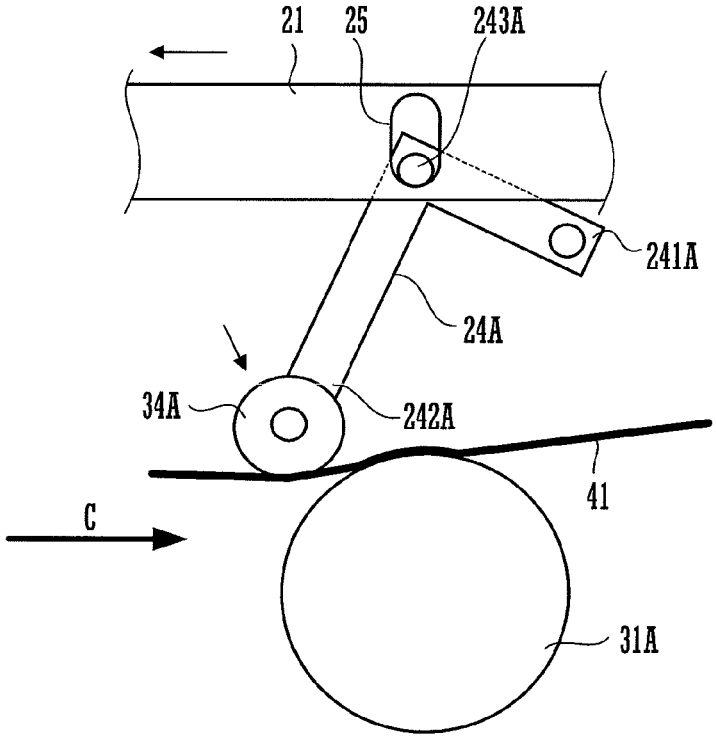

FIGS. 5A to 5C are views illustrating the arrangement of the transfer member moving mechanism 20, specifically, FIG. 5A illustrates the transfer member moving mechanism 20 in the standby state, FIG. 5B illustrates the transfer member moving mechanism 20 in the monochrome image forming state, and FIG. 5C illustrates the transfer member moving mechanism 20 in the full-color image forming state.

As shown in FIGS. 5A to 5C and FIGS. 6A and 6B, the transfer member moving mechanism 20 includes a first link member 21, a second link member 22, a cam 23, and first to fourth arms 24A to 24D.

The first to fourth arms 24A to 24D are each L-shaped. The second to fourth arms 24B to 24D are similar to the first arm 24A. The first arm 24A has a first end portion 241A pivotally supported on a non-illustrated frame of the intermediate transfer belt unit 40. The first arm 24A has a second end portion 242A supporting the intermediate transfer roller 34A for rotation. Likewise, the second to fourth arms 24B to 24D each have a second end portion supporting a respective one of the intermediate transfer rollers 34B to 34D for rotation.

The first link member 21 has a vertically elongated slit 25 associated with the intermediate transfer roller 34A. The second link member 22 has vertically elongated slits each associated with a respective one of the intermediate transfer rollers 34B to 34D.

The first arm 24A has a bent portion provided with a projecting portion 243A projecting parallel with the rotational axis of the intermediate transfer roller 34A. The projecting portion 243A is displaceable within the slit 25 of the first link member 21. The second to fourth arms 24B to 24D have their respective projecting portions which are each displaceable within a respective one of the slits of the second link member 22.

As the first link member 21 moves toward the upstream side in the moving direction C of the intermediate transfer belt 41, the projecting portion 243A descends within the slit 25 to lower the intermediate transfer roller 34A into its pressing position. Thus, the intermediate transfer belt 41 is pressed against the photoreceptor drum 31A. On the other hand, as the first link member 21 moves toward the downstream side in the moving direction C of the intermediate transfer belt 41, the projecting portion 243A ascends within the slit 25 to raise the intermediate transfer roller 34A into its separating position. Thus, the intermediate transfer belt 41 is separated from the photoreceptor drum 31A.

Likewise, as the second link member 22 moves toward the upstream side in the moving direction C of the intermediate transfer belt 41, the intermediate transfer rollers 34B to 34D descend into their respective pressing positions. As the second link member 22 moves toward the downstream side in the moving direction C of the intermediate transfer belt 41, the intermediate transfer rollers 34B to 34D ascend into their respective separating positions.

The pressing position of the intermediate transfer roller 34A is established depending on the size of the slit 25, the position of the slit 25 in the first link member 21, the length of the first arm 24A, and the like. Similarly, the pressing positions of the respective intermediate transfer rollers 34B to 34D are established depending on the sizes of the respective slits, the positions of the respective slits in the second link member 21, the lengths of the second to fourth arms 24B to 24D, and the like.

Figure 7A:
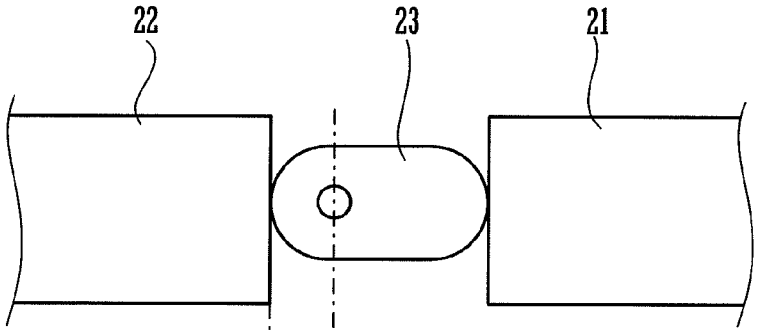
FIGS. 7A to 7C are enlarged views of another part of the transfer member moving mechanism, specifically.
Figure 7B:
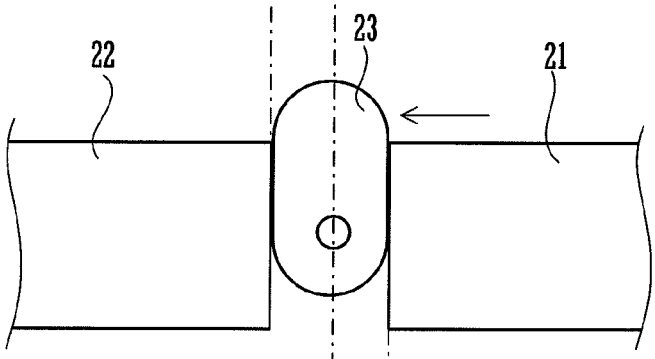
Figure 7C:
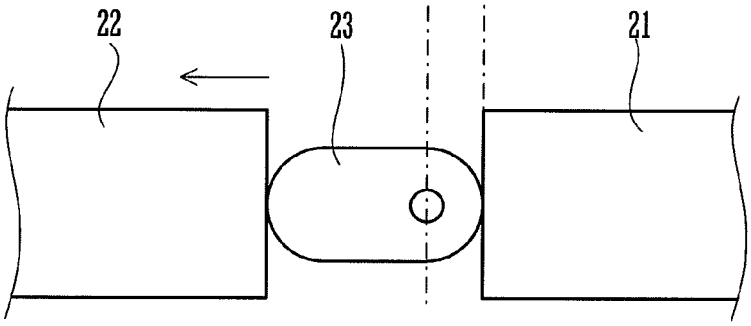
Figure 7C:
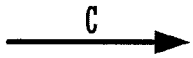

FIG. 7A illustrates the transfer member moving mechanism 20 in the standby state, FIG. 7B illustrates the transfer member moving mechanism 20 in the monochrome image forming state, and FIG. 7C illustrates the transfer member moving mechanism 20 in the full-color image forming state.

As shown in FIGS. 7A to 7C, the cam 23 comprises an eccentric cam. The first and second link members 21 and 22 are biased toward the cam 23. When the transfer member moving mechanism 20 is in the standby state as shown in FIG. 7A, the cam 23 is oriented in a first direction. The cam 23 thus oriented causes both of the first and second link members 21 and 22 to be positioned on the downstream side in the moving direction C, so that the intermediate transfer rollers 34A to 34D assume their respective separating positions.

When the transfer member moving mechanism 20 is in the monochrome image forming state as shown in FIG. 7B, the cam 23 is oriented in a second direction by 90° rotation in FIG. 7B from the standby state. The cam 23 thus oriented causes the first link member 21 to be positioned on the upstream side in the moving direction C, so that the intermediate transfer roller 34A assumes its pressing position. The second link member 22 remains on the downstream side in the moving direction C, so that the intermediate transfer rollers 34B to 34D remain in their respective separating positions.

When the transfer member moving mechanism 20 is in the full-color image forming state as shown in FIG. 7C, the cam 23 is oriented in a third direction by 180° rotation in FIG. 7C from the standby state. The cam 23 thus oriented causes both of the first and second link members 21 and 22 to be positioned on the upstream side in the moving direction C, so that the intermediate transfer rollers 34A to 34D assume their respective pressing positions.

Figure 8:
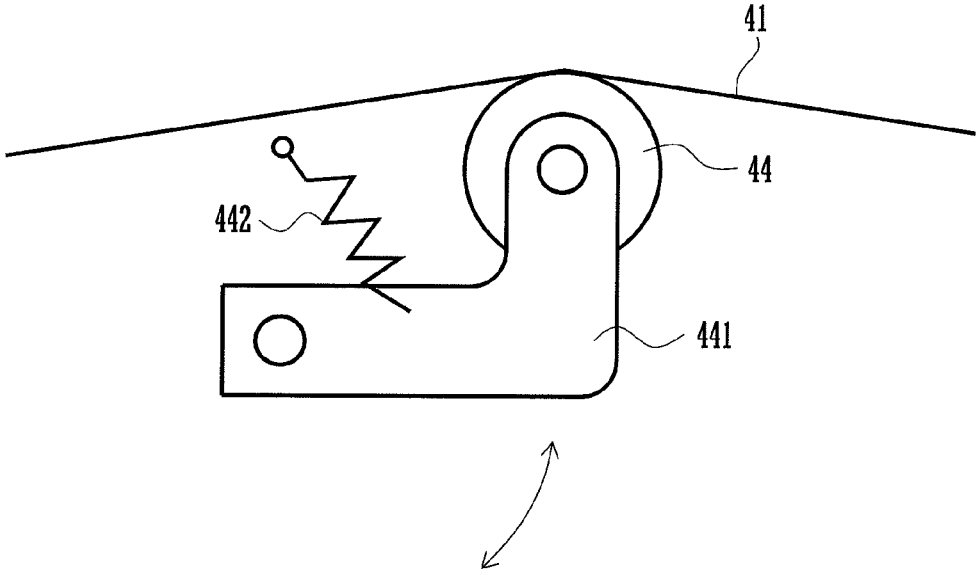
FIG. 8 is a view illustrating the arrangement of a tension roller.

The tension roller 44 is pressed against the inner peripheral surface of the intermediate transfer belt 41 as shown in FIG. 8. The tension roller 44 is rotatably supported on a top end portion of an arm 441. The arm 441 has a base end portion rotatably supported on the non-illustrated frame of the intermediate belt unit 40. The arm 441 is biased by a spring 442 in a direction such as to press the tension roller 44 against the intermediate transfer belt 41. Therefore, the tension roller biases the intermediate transfer belt 41 toward the outer side by a predetermined elastic force.

Thus, the position of the tension roller 44 changes correspondingly to the positions of the respective intermediate transfer rollers 34A to 34D in such a manner as to meet the standby state, the monochrome image forming state or the full-color image forming state, as shown in FIGS. 2A to 2C. Specifically, the tension roller 44 in the monochrome image forming state is positioned to expand the intermediate transfer belt 41 more outwardly than in the full-color image forming state; and the tension roller 44 in the standby state is positioned to expand the intermediate transfer belt 41 more outwardly than in the monochrome image forming state. By so doing, the tension of the intermediate transfer belt 41 is kept constant throughout all the states, i.e., the standby state, monochrome image forming state and full-color image forming state.

The intermediate transfer roller 34D located on the most upstream side in the moving direction C may be used for monochrome image formation.

While the foregoing embodiment uses toners of four colors, the present invention can exercise the effect of downsizing the transfer device 10 and the image forming apparatus 100 in the moving direction C of the intermediate transfer belt 41 even when the present invention is applied to an arrangement using toners of a larger number of colors, for example, six colors or eight colors.

The transfer member moving mechanism 20 is not limited to the arrangement for moving the intermediate transfer rollers 34A to 34D in the vertical direction perpendicular to the moving direction C of the intermediate transfer belt 41. The transfer member moving mechanism 20 may be designed to move the intermediate transfer rollers 34A to 34D in any direction other than the vertical direction perpendicular to the moving direction C as long as the transfer member moving mechanism 20 is capable of moving the intermediate transfer rollers 34A to 34D between their pressing positions for pressing the intermediate transfer belt 41 against the plurality of photoreceptor drums 31A to 31D and their separating positions for separating the intermediate transfer belt 41 from the photoreceptor drums 31A to 31D.

The foregoing embodiments should be construed to be illustrative and not limitative of the present invention in all the points. The scope of the present invention is defined by the following claims, not by the foregoing embodiments. Further, the scope of the present invention is intended to include the scopes of the claims and all possible changes and modifications within the senses and scopes of equivalents.

What is claimed is:

1. A transfer device incorporated in an image forming apparatus for performing a primary transfer of developer images from a plurality of image bearing members arranged side by side onto an intermediate transfer belt and then performing a secondary transfer of the developer images from the intermediate transfer belt onto a recording medium, the transfer device comprising:

the intermediate transfer belt entrained about first and second entraining rollers to form a loop-shaped moving path opposed to the plurality of image bearing members;

a plurality of transfer members opposed to the respective image bearing members across the intermediate transfer belt for performing the primary transfer of the developer images born on the respective image bearing members onto the intermediate transfer belt when the transfer members are applied with voltage; and a transfer member moving mechanism configured to move the plurality of transfer members between their respective pressing positions for pressing the intermediate transfer belt against the plurality of image bearing members and their respective separating positions for separating the intermediate transfer belt from the plurality of image bearing members, wherein a most upstream side transfer member which is a most upstream one of the plurality of transfer members in a moving direction of the intermediate transfer belt within a region opposed to the plurality of image bearing members has a rotational axis arranged downstream from a rotational axis of a most upstream side image bearing member which is a most upstream one of the plurality of image bearing members in the moving direction of the intermediate transfer belt when the most upstream side transfer member is in its pressing position, while a most downstream side transfer member which is a most downstream one of the plurality of transfer members in the moving direction of the intermediate transfer belt within the region opposed to the plurality of image bearing members has a rotational axis arranged upstream from a rotational axis of a most downstream side image bearing member which is a most downstream one of the plurality of image bearing members in the moving direction of the intermediate transfer belt when the most downstream side transfer member is in its pressing position, and the pressing positions of the most upstream side transfer member and the most downstream side transfer member are set closer to the plurality of image bearing members than those of the other transfer members in a direction perpendicular to the moving direction.

2. An image forming apparatus comprising the transfer device according to claim 1.

3. The transfer device according to claim 1, wherein lowermost portions of the first and the second entraining rollers are positioned higher than uppermost portions of the plurality of image bearing members in a state in which the intermediate transfer belt is positioned above the plurality of image bearing members.

4. The transfer device according to claim 1, wherein either one of the first and the second entraining rollers which is located upstream of the other one of the first and the second entraining rollers in the moving direction partially overlaps the most upstream side image bearing member in the moving direction.

* * * * *